United States Patent [19]

Cipris et al.

[11] 4,108,745

[45] Aug. 22, 1978

[54] SELENIUM-CONTAINING COATING FOR VALVE METAL ELECTRODES AND USE

[75] Inventors: Divna Cipris, Morristown, N.J.; Dirk Pouli, Williamsville, N.Y.

[73] Assignee: Allied Chemical Corporation, Morris Township, Morris County, N.J.

[21] Appl. No.: 786,704

[22] Filed: Apr. 11, 1977

[51] Int. Cl.[2] ..... C25B 1/02; C25B 11/08; C25B 11/10

[52] U.S. Cl. ..... 204/129; 204/290 F

[58] Field of Search ..... 204/290 F, 290 US, 43 T, 204/43 N, 56 R, 129, 290 F

[56] References Cited

U.S. PATENT DOCUMENTS

| | | | |
|---|---|---|---|
| 3,663,414 | 5/1972 | Martinson et al. | 204/290 F |
| 3,839,181 | 10/1974 | Degueldre et al. | 204/290 F |
| 3,929,608 | 12/1975 | Degueldre et al. | 204/290 F |

*Primary Examiner*—F.C. Edmundson

*Attorney, Agent, or Firm*—Gerhard H. Fuchs; Robert A. Harman

[57] ABSTRACT

Metal electrodes having a conductive coating comprising one or more elements of the platinum group, in metallic or oxidized form, together with selenium in oxidized form have enhanced catalytic activity for oxygen evolution in both acidic and alkaline media.

18 Claims, 4 Drawing Figures

OXIDATION OF SELENIUM IN 1 M $H_2SO_4$

SELENIUM-CONTAINING COATING FOR VALVE METAL ELECTRODES AND USE

BACKGROUND OF THE INVENTION

Metal electrodes composed of a metal base, such as titanium and tantalum, having coatings of mixed metal oxides, especially of metals of the platinum group, have been known for some time (see, e.g., South African Pat. No. 68/7482). Such electrodes, being resistant to attack under electrolysis conditions, are dimensionally stable and permit construction of electrolytic cells having higher capacity and reduced electrical energy requirements. For these reasons, they have found wide use in the production of alkali metal hydroxide and chlorine by electrolysis of salt brine. Numerous variations of dimensionally stable metal electrodes have been patented and have been described in the literature. For example, G. Bianchi has investigated discharge of chlorine by brine electrolysis employing platinum and platinum alloy electrodes, especially platinum/iridium electrodes, as well as metallic electrodes coated with metallic oxides, especially those coated with oxides of ruthenium, iridium and titanium [J. Appl. Electrochem. 1 (1971) 231-243]. Atanasoski et al. investigated oxygen evolution reaction on titanium-based platinum/iridium-catalyzed dimensionally stable anodes and concluded that such anodes have smaller polarization than metals commonly used as catalysts in oxygen evolution [J. Appl. Electrochem. 5 (1975) 159-163]. German Offenlegungschrift No. 2,045,348 describes titanium-based metal electrodes having an active coating of a solid solution of titanium dioxide and at least one dioxide of chromium, manganese and/or rhenium. Metal electrodes containing a conductive coating incorporating tellurium together with other coating substances are described in German Offenlegungscrhift No. 2,136,391 and 2,136,394.

It is an object of the present invention to provide conductive coatings for metal electrodes having improved catalytic activity for oxygen generation in electrochemical processes.

It is another object of the present invention to provide such coatings for electrodes for use in electrochemical processes involving oxidation of organic compounds.

It is a further object of the present invention to provide electrodes for electrochemical processes having enhanced catalytic activity for oxygen evolution in electrochemical processes in both acidic and alkaline media.

SUMMARY OF THE INVENTION

The present invention provides conductive coatings for metal electrodes comprising one or more elements of the platinum group, in metallic or oxidized form, together with selenium in oxidized form.

The present invention further provides electrodes for use in electrochemical processes comprising a metallic base comprising a metal selected from the group consisting of titanium, tantalum, niobium, tungsten, zirconium, molybdenum, bismuth and mixtures thereof, having deposited thereon a conductive coating comprising one or more elements of the platinum group, in metallic or oxidized form, together with selenium in oxidized form.

For purposes of the present invention, the elements of the platinum group include platinum, iridium, ruthenium, osmium, palladium and rhodium.

Our invention is in part based on the surprising discovery that metal electrodes having a conductive coating comprising one or more elements of the platinum group, in metallic or oxidized form, critically distinguished in further containing selenium in oxidized form have enhanced catalytic activity for oxygen evolution in both acidic and alkaline media, as compared to other metal electrodes containing coatings of metallic oxides, or of metals or alloys of metals of the platinum group, including such coatings further containing tellurium in oxidized form.

BRIEF DESCRIPTION OF THE DRAWINGS

The surprising catalytic activity of the conductive coatings for metal electrodes, and of the coated metal electrodes of the present invention is demonstrated in the attached drawings, wherein.

Figure 1:
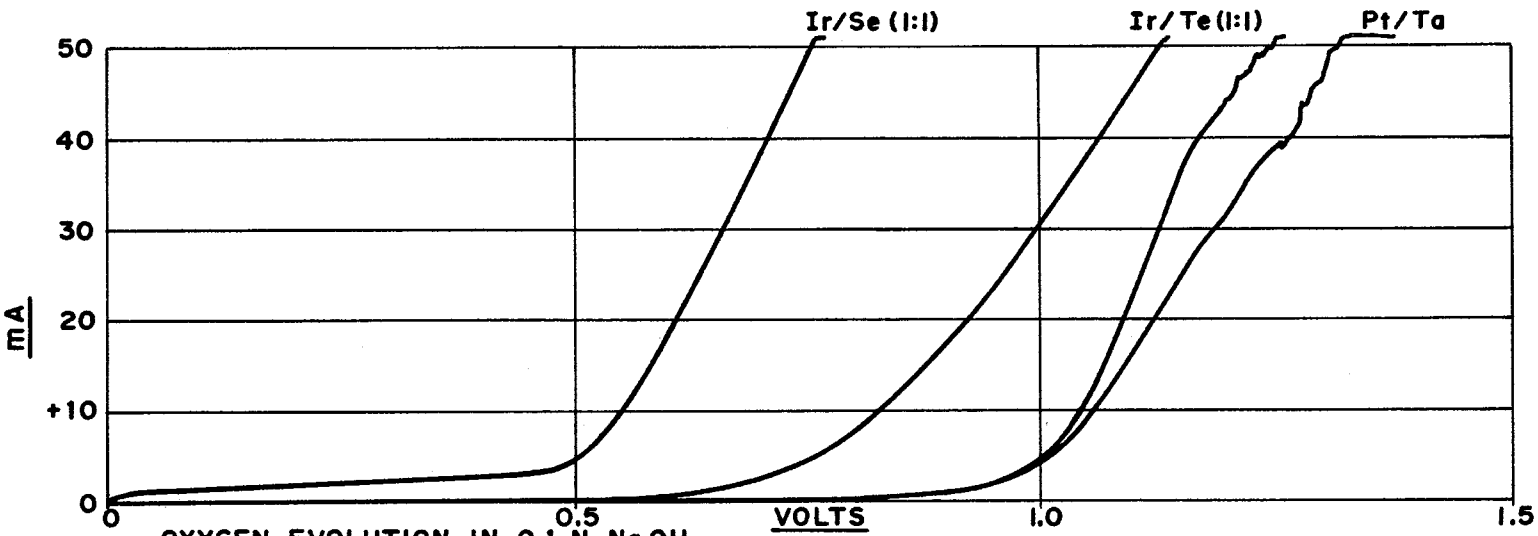
FIG. 1 and FIG. 2 represent linear polarization plots relating to oxygen evolution by electrolysis of 0.1 N NaOH and 1 M $H_2SO_4$, respectively, using iridium/-selenium- and iridium/tellurium-coated anodes, and platinum/tantalum anodes.

DETAILED DESCRIPTION OF THE INVENTION, OF THE PREFERRED EMBODIMENTS, AND OF THE BEST MODE PRESENTLY COMTEMPLATED FOR ITS PRACTICE

As previously stated, the conductive coatings for metal electrodes of the present invention comprise one or more elements of the platinum group, in metallic or oxidized form, together with selenium in oxidized form. The elements of the platinum group, for purposes of the present invention, include platinum, iridium, osmium, palladium, rhodium and ruthenium. These may be employed individually or in mixtures, such as mixtures of oxides thereof, or in alloys of two or more of the metals thereof, in any proportion.

The proportions of the elements of the platinum group and the selenium in the coatings of the present inventions, on atomic basis, may range from about 1:100 to about 100:1, desirably from 1:10 to about 10:1, preferably from about 1:5 to about 5:1, and most preferably from about 1:2 to 2:1.

Preferred elements of the platinum group are those selected from the group consisting of platinum, iridium, ruthenium and mixtures thereof in any proportion. Mixtures of platinum and iridium, in metallic or oxidized form, together with selenium in oxidized form, and mixtures of platinum and ruthenium, in metallic or oxidized form, together with selenium in oxidized form, are preferred combinations. In each of these combinations the platinum and ruthenium, and the platinum and iridium, are desirably employed in atomic ratio of about 1:10 to about 10:1, preferably in atomic ratio of about 1:2 to about 2:1. A conductive coating comprising iridium, in metallic or oxidized form, together with selenium in oxidized form is a specific example of a preferred conductive coating of the present invention.

The electrodes for use in electrochemical processes of the present invention are composed of a metallic base comprising a metal selected from the group consisting of titanium, tantalum, niobium, tungsten, zirconium, molybdenum, bismuth and alloys thereof, having deposited thereon a conductive coating, as above described. Desirably, electrodes of the present invention have a metallic base of titanium or tantalum, preferably of titanium. For reasons such as strengths and conductivity, as well as cost reduction, it may be desirable to provide a composite metallic base composed of a core of a conductive metal of relatively high strength, such as copper and silver, enclosed within a layer of titanium, which in turn carries the conductive coating.

The conductive coatings of the present invention may be applied to a suitable substrate, such as the metallic base of titanium, tantalum, niobium, tungsten, zirconium, molybdenum and bismuth, in the usual manner as by dipping the substrate into a solution or suspension of the platinum group metal, in soluble or dispersible form, say in the form of a water-soluble salt, in admixture with selenium in soluble form, say as selenous or selenic acid, in the desired proportions, followed by evaporation of the solvent or dispersant, and finally by a thermal treatment, desirably in an oxidizing atmosphere, preferably in air, at temperatures in the order of about 300° to about 600° C. Desirably, several cumulative layers of the coating are applied consecutively to obtain a coating of desired thickness.

The following Examples further illustrate the present invention and set forth the best mode presently contemplated for its practice.

EXAMPLE 1

An iridium/selenium coated titanium electrode was prepared as follows: To a ten milliliter portion of 0.1 molar $IrCl_3.H_2O$ in dimethyl formamide were added 150 miligrams selenous acid ($H_2SeO_3$). A thoroughly cleaned titanium screen electrode was dipped into this solution and dried in a furnace at 350° C for 10 minutes. Dipping and drying was repeated 10 times. After the final treatment, the electrode was heated in air in a furnace for 1 to 2 hours at 350° to 450° C. An adhering coating containing iridium/selenium in 1:1 atomic ratio was thus deposited onto the titanium electrode. Prior to the treatment the titanium screen electrode had been cleaned by rinsing it in acetone, boiling it in 1:2 conc. $HCl/H_2O$ for a few minutes, followed by rinsing in water, then acetone, and drying in air.

EXAMPLE 2

The procedure of Example 1 was repeated employing a coating solution obtained by adding 60 milligrams of selenous acid ($H_2SeO_3$) to 2 milliters of 0.1 molar $IrCl_3.H_2O$, in dimethylformamide. The coated electrode contained iridium/selenium in 1:2 atomic ratio.

For comparative electrolysis tests to be described below, iridium/tellurium-coated titanium electrodes were prepared following the procedure of Example 1 employing as coating solution 2 milliliter of 0.1 molar $IrCl_3.H_2O$ in dimethylformamide to which had been added 62 milligrams of $TeCl_4$.

Metal electrodes carrying a conductive coating in accordance with the present invention are particularly suited for electrolytic processes involving oxygen evolution, in alkaline as well as in acidic media; for use in processes involving electrolytic oxidation of organic compounds; for electrolytic oxidation of selenium to the higher valent states, as well for electrolytic reactions in general.

In electrolytic reactions involving oxygen formation, oxidation of organic compounds as well as oxidation of selenium compounds, use of electrodes coated with a conductive coating in accordance with the present invention permits conducting the electrolysis at significantly lower voltages than is possible with noble metal or noble metal-coated electrodes, including those incorporating tellurium in the coating. This is demonstrated in in the below-described electroysis tests wherein current-voltage curves (linear polarization plots) were obtained employing as anodes metal electrodes coated with a conductive coating in accordance with the present invention, as well as employing prior art electrodes. In these tests, a three-compartment cell was employed of conventional design having anolyte and catholyte compartments separated by a fritted glass disc to prevent gross electrolyte transfer. A calomel reference electrode was used to monitor electrode potentials of the working electrode (anode). The anode had a geometric area of one square centimeter. The cathode consisted of platinized tantalum. A stream of argon was employed to purge oxygen from the electrolyte. Voltage was applied at a scan rate of 10 millivolts per second. Current-voltage curves were automatically plotted. All tests were conducted at room temperature (about 22° C). The results of these tests are shown in the drawings.

Oxygen Evolution in an Alkaline Medium

FIG. 1 shows the current-voltage curves obtained in 0.1 N NaOH using (1) an iridium/selenium-coated anode of the present invention, prepared as described in Example 1, above, in comparison with (2) an iridium/-tellurium-coated anode prepared as described above, as well as (3) a conventional platinum/tantalum-coated titanium electrode. As FIG. 1 demonstrates, oxygen evolution on the iridium/selenium-coated anode in accordance with the present invention occurs at significantly lower voltate than on the iridium/tellurium and platinum/tantalum-coated electrodes of the prior art.

Oxygen Evolution in an Acidic Medium

Figure 2:
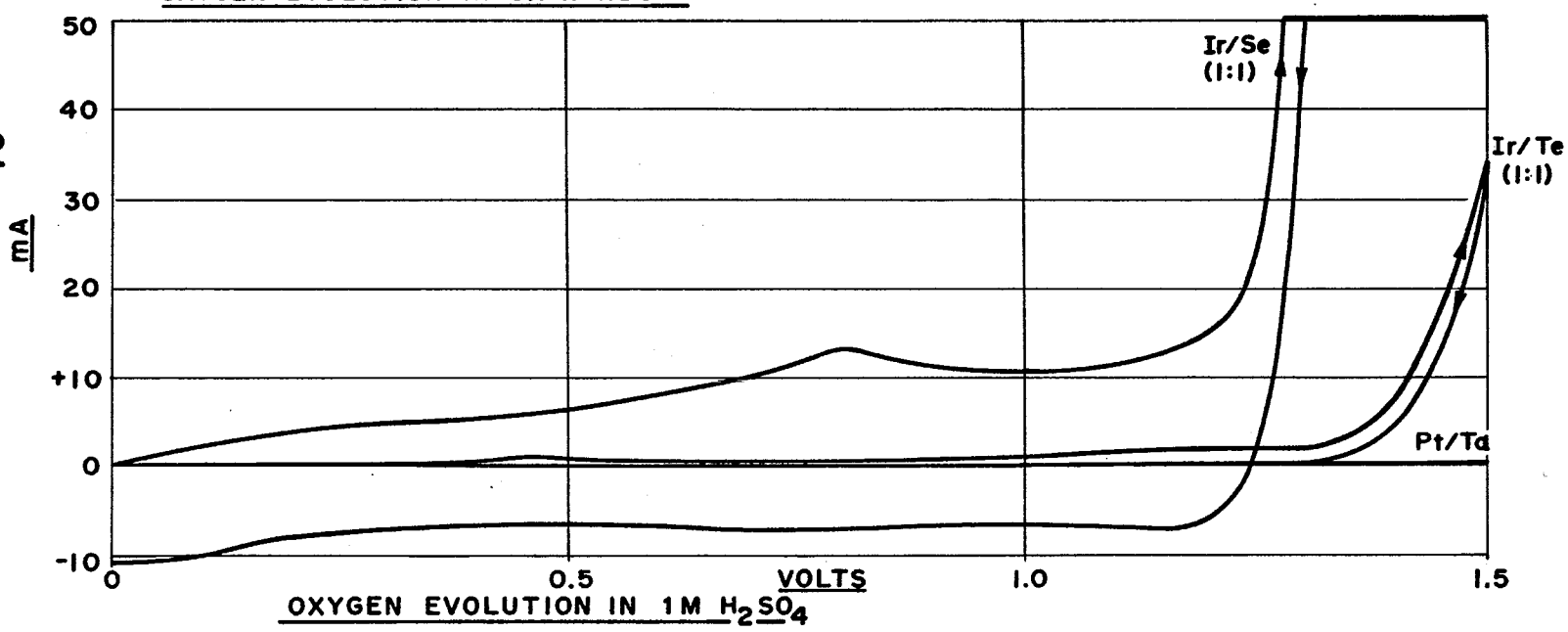

FIG. 2 shows current-voltage curves obtained by electrolysis of 1 M sulfuric acid employing (1) an iridium/selenium-coated titanium electrode prepared as per Example 1, above, in comparison with (2) an iridium/-tellurium-coated electrode prepared as above described, as well as (3) a conventional platinum/tantalum-coated electrode. As the curves in FIG. 2 demonstrate, oxygen evolution in an acidic medium on a coated electrode in accordance with the present invention occurs at significantly lower voltage than on the platinum/tantalum and iridium/tellurium-coated electrodes of the prior art.

Oxidation of an Organic Compound (Dimethylsulfoxide)

Figure 3:
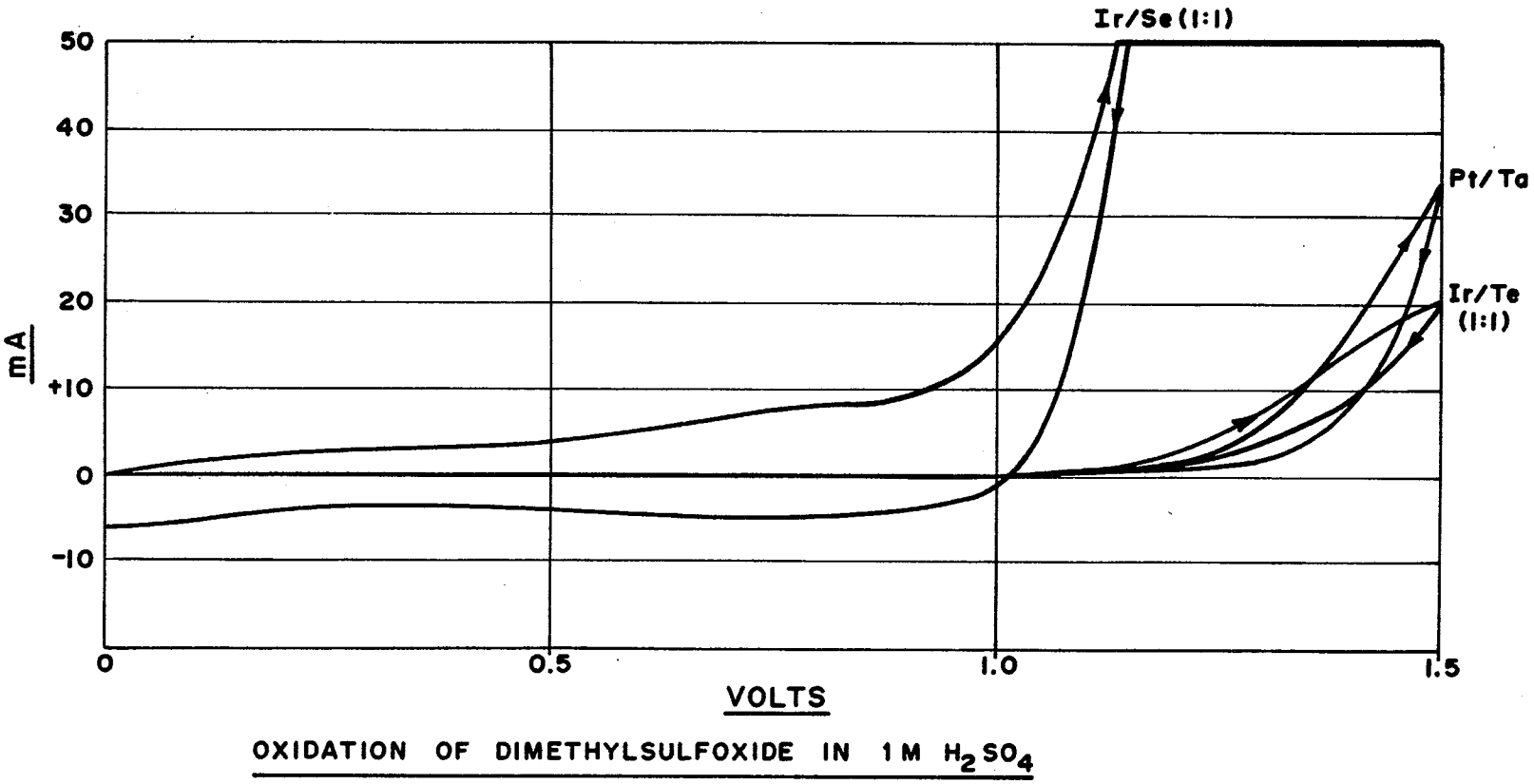
FIG. 3 is a linear polarization plot showing electrolytic oxidation of dimethylsulfoxide in one molar sulfuric acid (1:1) using anodes having coatings of iridium/-selenium and iridium/tellurium, and using a platinum/-tantalum anode.

FIG. 3 shows comparative current-voltage curves for oxidation of dimethylsulfoxide, presumably to dimethyl sulfone, in a 1:1 mixture of dimethylsulfoxide/1 M $H_2SO_4$. The curves in FIG. 3 demonstrate the surprising effectiveness of selenium-containing coated electrodes in accordance with the present invention in effecting catalytic oxidation of oxidizable organic compounds as compared to platinum/tantalum and iridium/tellurium-coated electrodes of the prior art. By recording current-potential (voltage) curves in the supporting electrolyte (1 M $H_2SO_4$), no current is observed until the potential of oxygen evolution is reached (visible gas evolution on the anode). Introduction of dimethylsulfoxide results in a current flow without gas evolution prior to oxygen evolution, indicating oxydation of the dimethylsulfoxide, presumably to the dimethylsulfone.

Oxidation of Selenium

Figure 4:
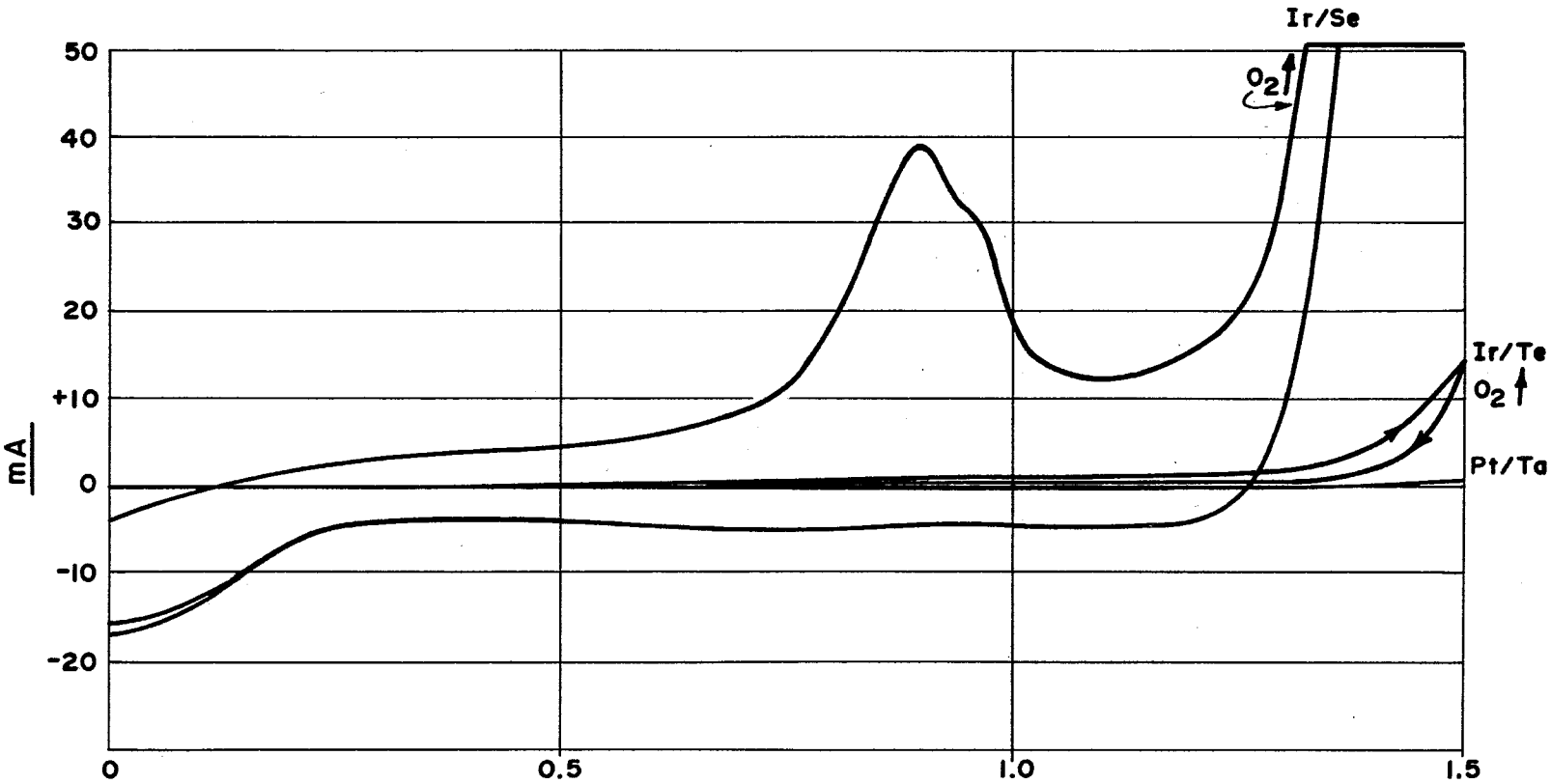
FIG. 4 is a linear polarization plot obtained on electrolytic oxidation of selenium in one molar sulfuric acid using a metal anode of the present invention and using prior art anodes.

FIG. 4 shows comparative current-voltage curves for electrolytic oxidation of selenium in 1 M $H_2SO_4$ containing $1.5 \times 10^{-2} H_2SeO_3$, using an iridium/selenium-coated anode in accordance with the present invention, a well as an iridium/tellurium-coated electrode and a platinum/tantalum electrode of the prior art. The first peak appearing at about 0.9 volts for the iridium/selenium-coated anode in accordance with the present invention is due to the $Se \rightarrow SeO_3^{-2}$ oxidation reaction. The charge underneath the anodic peak corresponds to the amount of selenium deposited on the electrode during cathodic discharge. This anode, therefore, supports both oxidation and deposition of selenium.

When other metal electrodes carrying a selenium containing coating in accordance with the present invention are substituted for the iridium/selenium-coated electrodes employed in the above described procedures, similar results are obtained, that is to say, electroytic production of oxygen, in both alkaline and acidic media; oxidation of electrolytically oxidizable organic compounds (dimethylsulfoxide as well as others); and oxidation of selenium ion proceed at significantly lower voltages than those prevailing with the electrodes employed in the comparative tests.

Since various changes may be made in carrying out our invention without departing from its scope and essential characteristics, all matter contained in the above description shall be interpreted as illustrative only, the scope of our invention being defined by the appended claims.

We claim:

1. In the process for a electrolytically generating oxygen by passing an electrical current through an acidic or 2. The improvement of claim 1 wherein the metallic base of the electrode is composed of titanium.

3. The improvement of claim 2 wherein in the coating of the electrode the elements of the platinum group are selected from the group consisting of platinum, iridium, ruthenium and mixtures thereof.

4. The improvement of claim 3 wherein in the coating of the electrode the elements of the platinum group are a mixture of platinum and iridium.

5. The improvement of claim 3 wherein in the coating of the electrode the element of the platinum group is iridium.

6. The improvement of claim 1 wherein the electrolyte is an acidic electrolyte.

7. The improvement of claim 1 wherein the electrolyte is a basic electrolyte.

8. The improvement of claim 1 wherein the metallic base of the electrode comprises a metal selected from the group consisting of titanium, tantalum and mixtures thereof.

9. An electrode for use in electrochemical processes comprising:

(a) a metallic base comprising a metal selected from the group consisting of titanium, tantalum, niobium, tungsten, zirconium, molybdenum, bismuth, and mixtures thereof; having deposited thereon and in direct contact therewith (b) a conductive coating comprising one or more elements of the platinum group, in metallic or oxidized form, together with selenium in oxidized form.

10. An electrode according to claim 9 wherein the metallic base comprises a metal selected from the group consisting of titanium, tantalum, and mixtures thereof.

11. An electrode according to claim 10 wherein the metallic base is composed of titanium.

12. An electrode according to claim 11 wherein in the coating the elements of the platinum group are selected from the group consisting of platinum, iridium, ruthenium, and mixtures thereof.

13. An electrode according to claim 12 wherein in the coating the elements of the platinum group are a mixture of platinum and iridium.

14. An electrode according to claim 12 wherein the elements of the platinum group are a mixture of platinum and ruthenium.

15. An electrode according to claim 12 wherein the element of the platinum group is iridium.

16. An electrode according to claim 15 wherein metallic base is composed of a copper core covered by a layer of titanium.

17. An electrode according to claim 9 wherein the metallic base is composed of a core of a metal selected from the group consisting of copper and silver, covered by a layer of titanium.

18. An electrode according to claim 17 wherein the metallic base is composed of copper core covered by a layer of titanium.

* * * * *

UNITED STATES PATENT AND TRADEMARK OFFICE

CERTIFICATE OF CORRECTION

PATENT NO. : 4,108,745

DATED : August 22, 1978

INVENTOR(S) : Divna Cipris and Dirk Pouli

It is certified that error appears in the above-identified patent and that said Letters Patent are hereby corrected as shown below:

Col. 5, line 47, after "acidic or" should continue -- basic aqueous electrolyte, the voltage required for oxygen evolution is reduced by the improvement which comprises employing as anode an electrode comprising (a) a metallic base comprising a metal selected from the group consisting of titanium, tantalum, niobium, tungsten, zirconium, molybdenum, bismuth, and mixtures thereof; having deposited thereon and in direct contact therewith (b) a conductive coating comprising one or more elements of the platinum group, in metallic or oxidized form, together with selenium, in oxidized form. --

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*